United States Patent [19]

Hashigaki et al.

[11] Patent Number: 4,664,228

[45] Date of Patent: May 12, 1987

[54] LUBRICATION SYSTEM FOR A VERTICAL SHAFT ENGINE

[75] Inventors: Yasunori Hashigaki; Tatsutoshi Umeda, both of Sakai, Japan

[73] Assignee: Kubota Ltd., Osaka, Japan

[21] Appl. No.: 787,137

[22] Filed: Oct. 15, 1985

[30] Foreign Application Priority Data

Feb. 14, 1985 [JP] Japan ..... 60-19316[U]

[51] Int. Cl.[4] ..... F01M 1/04; F02B 75/06

[52] U.S. Cl. ..... 184/6.5; 184/6.18; 123/192 B; 123/198 C; 123/196 R

[58] Field of Search ..... 184/6.5, 6.6, 6.7, 6.8, 184/6.9, 6.18; 123/192 B, 196 R, 196 W; 74/603

[56] References Cited

U.S. PATENT DOCUMENTS

| | | | |
|---|---|---|---|
| 2,988,081 | 6/1961 | Etchells | 123/196 R |
| 3,903,995 | 9/1975 | Irgens | 123/196 R |
| 4,000,666 | 1/1977 | Ito | 123/192 B |
| 4,028,963 | 6/1977 | Nakamura | 123/192 B |
| 4,174,698 | 11/1979 | Dupin | 123/192 B |
| 4,508,069 | 4/1985 | Dobler | 123/192 B |
| 4,545,341 | 10/1985 | Corey | 123/192 B |

FOREIGN PATENT DOCUMENTS

| | | | |
|---|---|---|---|
| 75759 | 4/1983 | European Pat. Off. | 123/192 B |

*Primary Examiner*—Carlton R. Croyle
*Assistant Examiner*—Jane E. Obee
*Attorney, Agent, or Firm*—Schwartz, Jeffery, Schwaab, Mack, Blumenthal & Evans

[57] ABSTRACT

A lubrication system for a vertical shaft engine includes a crank case having an upper and a lower wall, a vertical crank shaft, a vertical balancing shaft, each pair of upper and lower bosses formed in said upper and lower walls for rotatably supporting these shafts an oil pump having a drive shaft housed in a lower boss for supporting said balancing shaft, and adopted to be driven by said balancing shaft, and an oil feeding passage for feeding lubricating oil from said pump to any part desired to be lubricated in said engine.

3 Claims, 6 Drawing Figures

LUBRICATION SYSTEM FOR A VERTICAL SHAFT ENGINE

BACKGROUND OF THE INVENTION

1. Field of the Invention

The present invention relates to a lubrication system, especially to a forced lubrication system for a vertical shaft engine.

2. Description of Prior Arts

A traditional forced lubrication system for a vertical shaft engine, which is proposed by the applicant of the present invention previously, is shown in FIG. 6.

In FIG. 6, a vertical shaft engine has a crank case 2, an oil pan 4 constituting the lower part of the crank case 2, a vertical crank shaft 7 supported rotatably by the crank case 2, and a vertical cam shaft 12 disposed to one side of the crank shaft 7, driven by the crank shaft 7 and supported rotatably by a pair of bosses 18 which are formed at the upper wall (not shown) and the lower wall 5 of the crank case 2. A trochoid pump 20 for lubrication is housed in the lower boss 18 for supporting the lower end of the cam shaft 12 under said cam shaft 12. Lubricating oil in the oil pan 4 is sucked by the pump and fed to the parts desired to be lubricated in the engine through an oil feeding passage 26 formed in the cam shaft 12.

In the traditional system described above, the pump 20 driven by the cam shaft 12 is rotated by the crank shaft 7 at half of the speed of the crank shaft 7. Therefore, in order to feed sufficient amounts of lubricating oil to every part desired to be lubricated, the pump 20 must have a large displacement for a round, and the boss 18 housing the pump 20 must be large. Accordingly, the capacity of said oil pan 4 is decreased corresponding to the size of the pump 20. And a large pump 20 having a large displacement is naturally expensive.

SUMMARY OF THE INVENTION

Therefore, the primary object of the present invention is to feed a sufficient amount of lubricating oil to every part desired to be lubrucated in the engine, and to ensure a large capacity in the oil pan.

An additional object of the present invention is to position the oil pump in such a way so as to cause no increase in the total height of the engine due to the presence of the oil pump.

To this end, the lubrication system for a vertical shaft engine, according to the present invention, comprises a crank case having an upper and a lower wall, a vertical crank shaft, a vertical balancing shaft, a plurality of pairs of upper and lower bosses formed in said upper and lower walls for supporting these shafts rotatably, an oil pump housed in said lower wall and adopted to be driven by said crank shaft, and an oil feeding passage for feeding lubricating oil from said pump to any part desired to be lubricated in said engine, wherein the improvement comprises; said pump having a drive shaft, housed in the lower boss for supporting said balancing shaft by an antifriction bearing rotatably mounted under said balancing shaft; and said drive shaft connected to the lower end of said balancing shaft.

Said balancing shaft is driven by the crank shaft, and drives said pump to suck lubricating oil from an oil pan and to feed it to every part where lublication is required in said engine.

Said balancing shaft may be made to balance with the primary or secondary unbalanced force of said crank shaft. When the engine has three or five cylinders, for example, the balancing shafts are driven at double the speed of the crank shaft in order to balance with the secondary unbalanced force. If the balancing shaft was made to balance with the primary unbalanced force, said balancing shaft is rotated at the same speed as said crank shaft.

Therefore, said pump is driven at higher speed, and double or four times the amount of lubricating oil is fed per a round by said pump to parts desired to be lubricated, in comparison with the traditional system. Thus, it becomes possible to make use of small and inexpensive pumps with small displacement per a round, while the sufficient amount of lubricating oil is fed to every part desired to be lubricated in a engine.

Moreover, on one hand, as the lower end of said balancing shaft is supported by said antifriction bearing, the diameters of said lower boss for supporting said balancing shaft, which is housing said antifriction bearing, is originally of a large size, corresponding to the diameter of said antifriction bearing, on the other hand, said pump may be small. Therefore, said lower boss for supporting said balancing shaft may be have a sufficient dead space in the lower part thereof for housing said pump without enlarging its original diameter. Thus, it becomes possible to house a small oil pump in the dead space of said boss, without decreasing any capacity in said oil pan. Accordingly, sufficient capacity of said oil pan can be ensured and a sufficient amount of lubricating oil can be ensured to be in said oil pan.

Said oil feeding passage may be formed in said balancing shaft, or in the lower half part of said crank shaft and in a rib formed on said lower wall, connecting said lower bosses for said crank shaft and said balancing shaft.

BRIEF DESCRIPTION OF THE DRAWINGS

The present invention will be understood more clearly and precisely upon reading the following detailed description of the preferred embodiments, which refers to the attached drawings, wherein like members or parts are designated with the same reference numeral, and wherein.

DETAILED DESCRIPTION OF PREFERRED EMBODIMENTS

Figure 1:
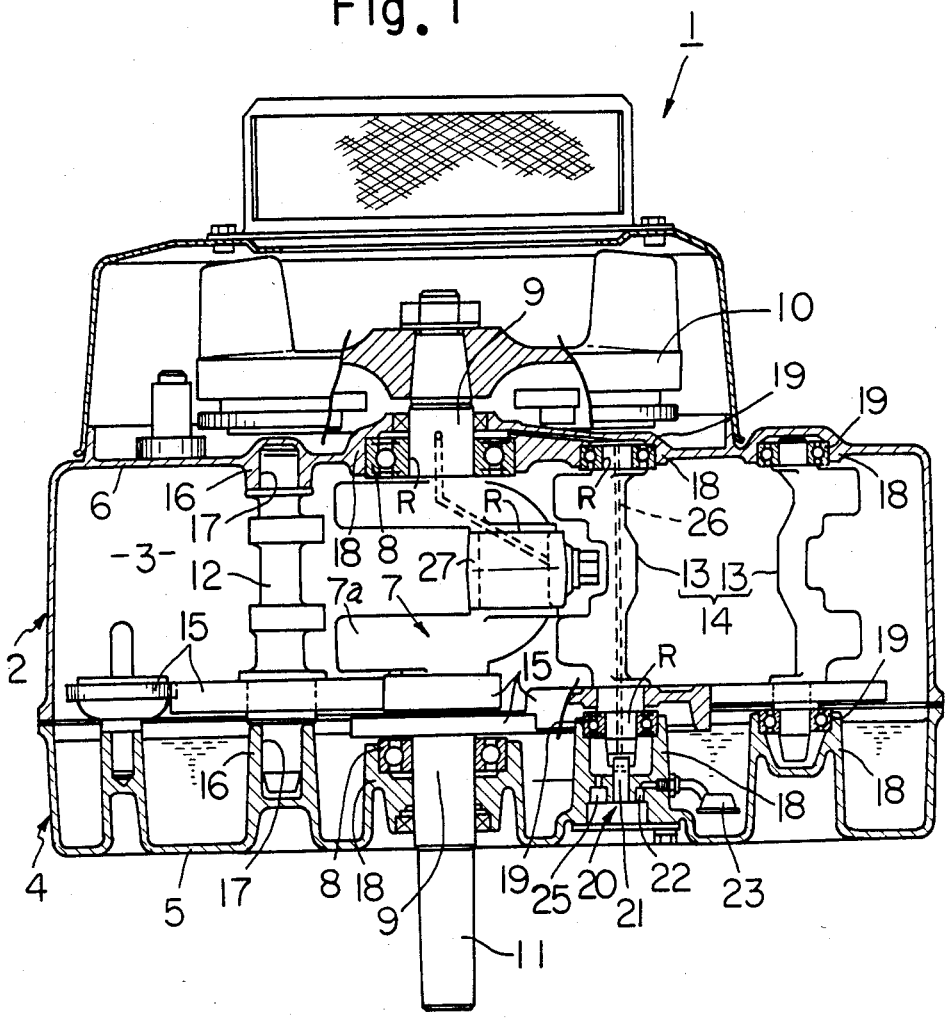
FIG. 1 is a vertical section of a forced air cooling vertical shafted engine according to the present invention.

Now, referring to the FIG. 1, a vertical shaft engine 1 has a crank case 2 a lower wall 5 which is constituted by an oil pan 4 covering the bottom opening of the crank room 3.

A crank shaft 7 penetrates through the upper wall 6 and the lower wall 5 of the crank case 2 at the almost center part of these walls 5 and 6.

A pair of bosses 18 are formed in the upper and lower walls 5, 6 at about their center parts. Each boss 18 houses a crank shaft bearing 8 made of a ball bearing through which each journal 9 formed at each end part of the crank shaft 7 is fitted.

A flywheel fan 10 for generating a flow of cooling air is fitted at the upper extruding part of the crank shaft 7, which part is extruded over the upper wall 6. The lower extruding part of the crank shaft 7 constitutes an output shaft 11.

A cam shaft 12 for controlling valves is disposed in the left side of the crank shaft 7 parallel therewith, and a balancing means 14 including a pair of balancing shafts 13 is disposed in right side of the crank shaft 7 parallel therewith respectively.

The crank shaft 7 is adopted to drive the cam shaft 12 at a half speed of crank shaft 7, and the balancing shafts 13 at the same speed of as crank shaft 7, by gears 15.

The cam shaft 12 receives a pair of biasing forces from a strong valve spring (not shown) in a radial direction by a pair of tappets (not shown). Therefore, the cam shaft 12 is borne by a pair of plain bearings 17 formed in a pair of bosses 16 for supporting the cam shaft 12. This pair of bosses 16 are extruded into crank room 3 from the upper and the lower walls 5 and 6 of the crank room 7.

On the other hand, each balancing shaft 13, which turns at double the speed of the cam shaft 12 and receives little radial force, is borne rotatably by a pair of antifriction bearings 19 housed in each boss 18 for supporting the balancing shaft 13, so as to reduce rotational resistance acting on the balancing shaft 13. These bosses 18 for supporting the balancing shafts 13 are formed in the upper and the lower walls 5, 6 of the crank case 7, and each antifriction bearing 19 is made of a ball bearing.

An oil pump 20 is housed in lower boss 18 for supporting the left balancing shaft 13. The pump 20 is a trochoid pump, and its driving shaft 21 is engaged with the lower end of the left balancing shaft 13 so as to be driven thereby.

A primary oil feeding passage 26 is penetrating through the left balancing shaft along its axis. And a secondary oil feeding passage is formed in the upper wall 6 from the upper boss 18 for supporting the left balancing shaft 13 to the other upper boss 18 for supporting the crank shaft 7, communicated with the primary oil feeding passage 26 in the upper boss for supporting the left balancing shaft 13. The third oil feeding passage communicated with the secondary oil feeding passage in the upper boss for supporting the crank shaft 7 is formed in the upper half part of the crank shaft from the periphery of the upper journal 9 there of to the periphery of crank pin, around which the large end 27 of the connecting rod is fitted.

The pump 20 is provided with an oil strainer 23 at its inlet port 22.

When the engine 1 is run, the crank shaft 7 drives the pump 20 by the left balancing shaft 13 and gears 15. And driven pump 20 sucks lubricating oil from the oil pan 4 through the oil strainer 23, and forcibly feeds it from feeding port 25 through the primary, the secondary and the third oil feeding passages 26 to such parts R desired to be lubricated as the bearings 8 for the crank shaft 7, the bearing 19 for the balancing shafts 13, the large end 27 of connecting rod and so on.

Figure 6:
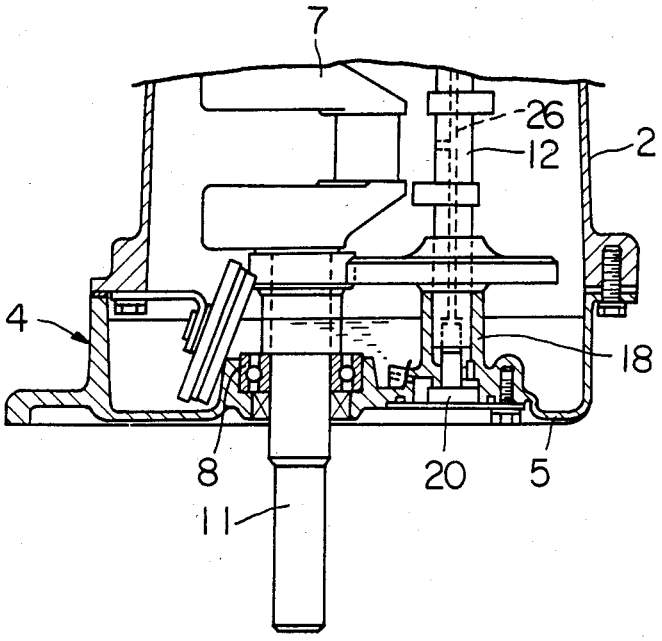
Fig. 6 PRIOR ART
FIG. 6 is a fragmentary vertical section of the traditional vertical shafted engine.

As the pump 20 is driven at double the speed of the cam shaft 12, the displacement of the pump 20 per cycle may be decreased by half the amount in comparison with the traditional system shown in FIG. 6. Thus, it becomes possible to make use of an inexpensive small pump that can be housed in the dead space in the lower boss 18 for supporting the left balancing shaft 13, housing the ball bearing 8 with large diameter, without incleasing the original diameter and volume of the boss 18. Accordingly, the capacity of the oil pan 4 is not decreased, and a sufficient amount of lubricating oil can be contained in the oil pan 4.

Figure 2:
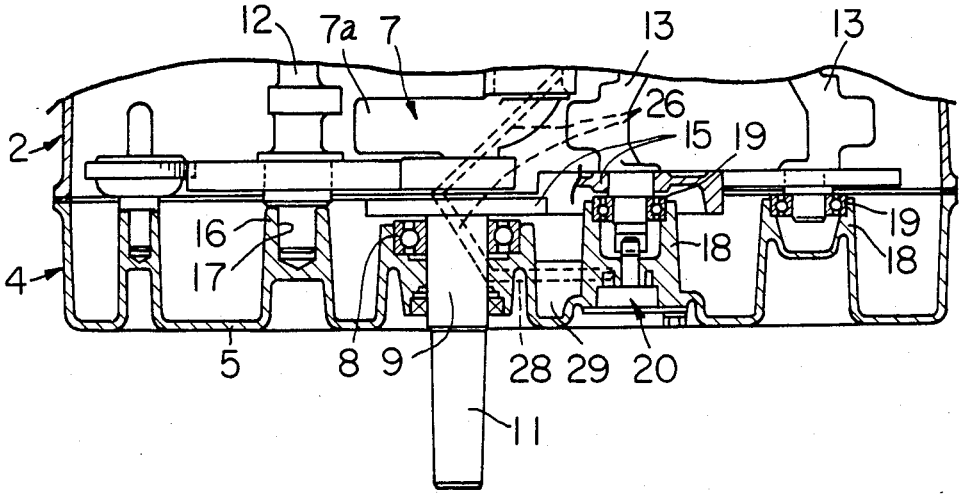
FIG. 2 is a fragmentary vertical section of another embodiment according to the present invention.

FIG. 2 designates a modified embodiment according to the present invention. In this embodiment, an oil feeding passage 26 is formed in the lower half part of the crank shaft 7 and communicates with the feeding port 25 of the oil pump 20 by a lateral oil feeding passage 28 formed through a rib 29 connecting the lower bosses 18 for supporting the crank shaft 7 and the balancing shaft 13. The volume of the rib 29 is so small that the capacity of the oil pan 4 is sacrificed little thereby.

Figure 3:
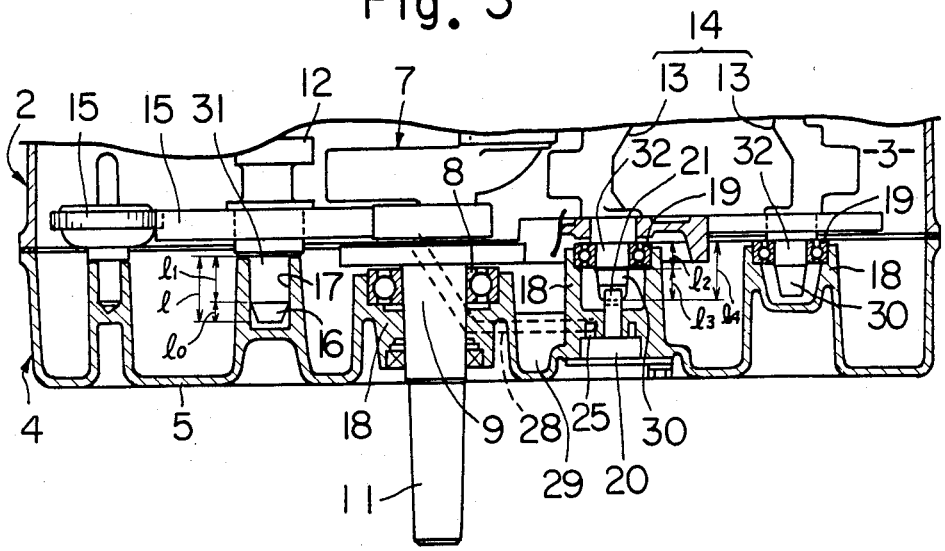
FIG. 3 is a fragmentary verticel section of the same embodiment shown in FIG. 2, which illustrates the relation between lengths of lower ends of the cam shaft and the balancing shaft.

As seen in FIG. 3, the balancing shaft 13 is provided with a leading part 30 at the lower end. This leading part 30 is tapered off, and the length $l_1$ of engagement of cam shaft journal 31 with the plain bearing 17 is longer than the length $l_2$ of engagement of balancing shaft journal 32 with the antifriction bearing 19, and shorter than a resultant length $l_4$ of the length $l_2$ of engagement of balancing shaft journal 33 with the antifriction bearing 19 and the axial length $l_3$ of leading part 30.

In the assembling process of the oil pan 4 to the crank case 2, at first the leading part 30, which is suspended from the upper wall 6 of the crank case 2 rotatably and unsteadily by a ball bearing 19, is loosely inserted in the inner hole of the ball bearing 19 housed in the lower boss 18 formed in the lower wall 5, then, the lower end of the cam shaft 12 is fitted into the plain bearing 17 formed in the lower boss 16, and finally the oil pan 4 is pressed to and fixed to the bottom surface of the crank case 2. The journal 32 of the balancing shaft 13 is fitted in the lower ball bearing 19 at the same time when the oil pan 4 is pressed to the crank case 2.

Therefore, there is no need to arrange the positions of lower ends of the cam shaft 12 and the balancing shaft 13 at the same time, and the assembling process is carried out easier and more efficiently than that of the traditional vertical shaft engine.

Figure 4:
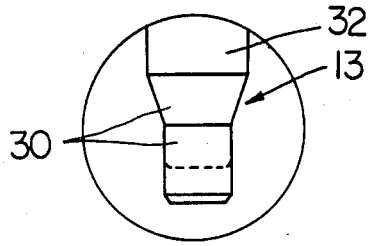
FIG. 4 is an enlarged fragmentary front view of a balancing shaft in FIG. 2.
Figure 5:
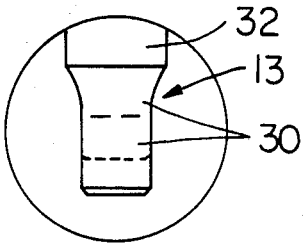
FIG. 5 is an enlarged fragmentary front view of a modified balancing shaft according to the present invention.

In this embodiment, the leading part may be modified as seen in FIGS. 4 and 5.

FIG. 4 designates a modified leading part 21 which has a linearly tapered part and a straight part with reduced diameter continued to the tapered part. A modified leading part 21 shown in FIG. 5 has a convergently tapered part and a straight part with reduced diameter continued to the tapered part.

In the preferred embodiment mentioned above, the lubricating system may be provided with a splashing vane for splashing lubricating oil from the oil pan in addition to the forced lubricating system with pump 20.

In the preferred embodiment mentioned above, the system involves two balancing shafts 13. But, it is possible to decrease the number of the balancing shaft 13 to one, when the crank shaft 7 has a balancing weight fixed to the counter weight part thereof.

What is claimed is:

1. A lubrication system for a vertical shaft engine comprising a crank case having an upper and a lower wall, a vertical crank shaft, a vertical balancing shaft, a plurality of upper and lower bosses formed in said upper and lower walls for rotatably supporting said shafts, an oil pump housed in said lower wall, and an oil feeding passage for feeding lubricating oil from said pump to any part desired to be lubricated in said engine, wherein the improvement comprises:

said pump having a drive shaft housed under said balancing shaft, the lower end of said balancing shaft housed in one of said lower losses, said balancing shaft being rotatably supported by an antifriction bearing;

said antifriction bearing being held in an upper part of said one lower boss;

said one lower boss protruding upward from said lower wall;

said drive shaft connected to the lower end of said balancing shaft and;

said pump being housed in a lower part of said one lower boss above said lower wall.

2. A lubricating system recited in claim 1, wherein a part of said oil feeding passage is formed through said balancing shaft.

3. A lubricating system recited in claim 1, wherein a part of said oil feeding passage is formed in the lower half part of said crank shaft.

* * * * *